US006030122A

United States Patent [19]

Ramsey et al.

[11] Patent Number: 6,030,122

[45] Date of Patent: Feb. 29, 2000

[54] PINCH-GRIP ZIPPER

[75] Inventors: Ronald L. Ramsey, Naperville; Arthur Malin, Northbrook; Robert Hogan, Burr Ridge; Lawrence Share, Skokie, all of Ill.; Richmond M. Scott, Pleasantville, N.Y.

[73] Assignee: Illinois Tool Works Inc., Glenview, Ill.

[21] Appl. No.: 09/036,232

[22] Filed: Mar. 6, 1998

[51] Int. Cl.[7] ..... B65D 33/16

[52] U.S. Cl. ..... 383/61; 24/587; 383/63

[58] Field of Search ..... 24/587, 576; 383/61, 383/63, 65, 5

[56] References Cited

U.S. PATENT DOCUMENTS

| | | | |
|---|---|---|---|
| 3,198,228 | 8/1965 | Naito . | |
| 3,338,284 | 8/1967 | Ausnit . | |
| 3,416,585 | 12/1968 | Staller . | |
| 3,425,469 | 2/1969 | Ausnit | 383/65 |
| 3,633,642 | 1/1972 | Siegel | 383/64 |
| 3,780,781 | 12/1973 | Uramoto | 383/61 X |
| 4,363,345 | 12/1982 | Scheibner . | |
| 4,430,070 | 2/1984 | Ausnit . | |
| 4,561,109 | 12/1985 | Herrington | 383/65 |
| 4,617,683 | 10/1986 | Christoff | 383/63 |
| 4,655,862 | 4/1987 | Christoff et al. | 383/63 X |
| 4,672,723 | 6/1987 | Hugues et al. | 383/63 X |
| 4,683,015 | 7/1987 | Wagers | 383/63 X |
| 4,736,451 | 4/1988 | Ausnit | 383/65 |
| 4,736,496 | 4/1988 | Fisher et al. | 383/63 X |
| 4,767,220 | 8/1988 | Kamp | 383/65 X |
| 4,792,240 | 12/1988 | Ausnit | 383/63 |
| 4,796,300 | 1/1989 | Branson | 383/63 |
| 4,929,487 | 5/1990 | Tilman et al. | 383/63 X |
| 5,012,561 | 5/1991 | Porchia et al. | 24/576 |
| 5,017,021 | 5/1991 | Simonsen et al. | 383/63 |
| 5,092,684 | 3/1992 | Weeks | 383/61 |
| 5,211,481 | 5/1993 | Tilman | 383/63 |
| 5,215,380 | 6/1993 | Custer et al. | 383/61 |
| 5,238,306 | 8/1993 | Heintz et al. | 383/61 |
| 5,384,942 | 1/1995 | Siegel | 24/587 |
| 5,551,127 | 9/1996 | May | 383/63 X |
| 5,577,305 | 11/1996 | Johnson | 24/587 |
| 5,660,479 | 8/1997 | May et al. | 383/63 X |
| 5,709,915 | 1/1998 | Tomic et al. | 383/61 X |

*Primary Examiner*—Stephen P. Garbe
*Assistant Examiner*—Robin A Hylton
*Attorney, Agent, or Firm*—Pitney, Hardin, Kipp and Szuch LLP

[57] ABSTRACT

A reclosable package for a consumer product includes a zipper strip having male and female interlocking profiles. The former has a male interlocking member having a cross section in the shape of an asymmetric arrowhead. The latter has a female interlocking member in the form of two mutually curving members defining a channel therebetween. The male interlocking member is snappingly engaged into the channel to reclose the package. The asymmetric male interlocking member has an acute edge outward of the interior of the package, and a rounded edge facing the inside of the package. This asymmetry makes the package easier to open from within than from without.

12 Claims, 4 Drawing Sheets

PINCH-GRIP ZIPPER

BACKGROUND OF THE INVENTION

1. Field of the Invention

The present invention relates to reclosable plastic bags of the type in which perishable food products and other goods are packaged for sale to consumers in retail outlets. More specifically, the present invention relates to reclosable plastic bags manufactured and concurrently filled on horizontal or vertica form-fill-and-seal (FFS) machines, wherein a plastic interlocking zipper for each bag is disposed transversely relative to the direction of motion of the thermoplastic sheet material used to form the reclosable bags on the FFS machine.

2. Description of the Prior Art

The present invention relates to improvements in the package-making art and may be practiced in the manufacture of thermoplastic bags and packages of the kind t at are used for various consumer products, but which are particularly useful for food products which must be kept in moisture- and air-tight packages, free from leakage before initially being opened for access to the product contents, which packages are then reclosable by zipper means to protect any remainder of the product therein.

The indicated art is fairly well-developed, but nevertheless remains open to improvements contributing to increased efficiency and cost effectiveness.

One problem that still hampers the production of packages from continuous zipper-equipped sheet material is the difficulty in attaining a satisfactory sealing of the bag or package against leakage, where the zipper extends through the side (cross) seal areas separating one bag or package from the next. The problem occurs where the zipper is longitudinal with respect to the direction of motion of the thermoplastic sheet material used to form the reclosable bags on the FFS machine, in which case the transverse, or side, sealing bars must flatten and seal the zipper at the same time as they are sealing the thermoplastic sheet material from which the packages are being made. The relatively high percent age of packages of this type which leak attests to the difficulty with which this is consistently and success fully achieved.

Numerous attempts have been made to solve this problem. Among the approaches that have been taken is the substitution of a transverse zipper for the longitudinal zipper. Where such a zipper is provided, the transverse sealing bars associated with the FFS machine do not flatten the zipper as they are making side seal, although they may seal the zipper to the thermoplastic sheet material transversely thereacross without flattening it.

The present invention relates to reclosable plastic bags or packages having transverse zippers. Where packages of this type are used to retail certain consumer products, such as snack foods, there is a preference among consumers for a package which may be initially opened by pinching its opposed side walls between the fingers of opposed hands below the seal at the top of the package, and by pulling the side walls apart to separate the top seal from within the package. This technique is difficult to follow where the zipper is of the type that is easier to open from outside the package, that is, from the consumer side, than from inside the package, that is, from the product side. The present invention is a zipper strip, and a reclosable package incorporating the zipper strip, which has been designed for use in situations where consumers prefer to open the package in this manner.

SUMMARY OF THE INVENTION

Accordingly, the present invention is a reclosable package for a consumer product, and a zipper strip used in the reclosable package.

The reclosable package includes a front panel and a rear panel, which are joined to one another to form a pack e tube sealed transversely at its top and its bottom by a top seal and a bottom seal.

The reclosable package incorporates a zipper strip which includes a male interlocking profile and a female interlocking profile. The male interlocking profile is attached to one of the front and rear panels transversely thereacross within the package tube adjacent to the top seal. The male interlocking profile has a male interlocking member and a male web extruded integrally therewith. The male web extends primarily in one direction from the male interlocking member toward the top seal. The male interlocking profile is attached to the front or rear panel at an end of the male web closest to the top seal.

The male interlocking member has a cross section in the shape of an asymmetric arrowhead with an acute edge and a rounded edge, the acute edge being oriented toward the top seal.

The female interlocking profile is attached to the other of the front and rear panels transversely thereacross within the package tube adjacent to the top seal. The female interlocking profile has a female interlocking member and a female web extruded integrally therewith. The female web extends primarily in one direction from the female interlocking member toward the top seal. The female interlocking profile is attached to the other of the front and rear panels at an end of said female web closest to the top seal.

The female interlocking member has two mutually curving members forming a channel therebetween, wherein the male interlocking member is snappingly engaged to join the male and female interlocking profile together to close the package. The male interlocking member is asymmetric, as previously indicated, having an acute edge oriented toward the top seal, and a rounded edge oriented toward the interior of the package. These characteristics of the male interlocking member make the reclosable package easier to open from within than from without.

One of the male and female webs has a portion extending toward the bottom seal. The rounded edge of the male interlocking member is oriented toward the portion, which is attached to either the front or the rear panel, or, more specifically, to the same panel as that of the web, male or female, from which it extend.

The portion of one of the male and female webs may be separated from the remainder by a line of perforations, which function in a manner to be described below to permit a consumer to open the package in the fashion previously described.

Alternatively, a portion of the male or female web may be attached to the front or rear panel only at the widthwise ends thereof, preferably by a peel seal or "tack" seal, so that, for the greater portion of the width of the package, the portion of the male or female web is attached to the front or rear panels only outwardly of the male and female interlocking profiles, thereby allowing the package to be opened in the consumer-preferred manner.

The present invention will now be described in more complete detail with frequent reference being made to the figures identified below.

DETAILED DESCRIPTION OF THE PREFERRED EMBODIMENT

Figure 1:
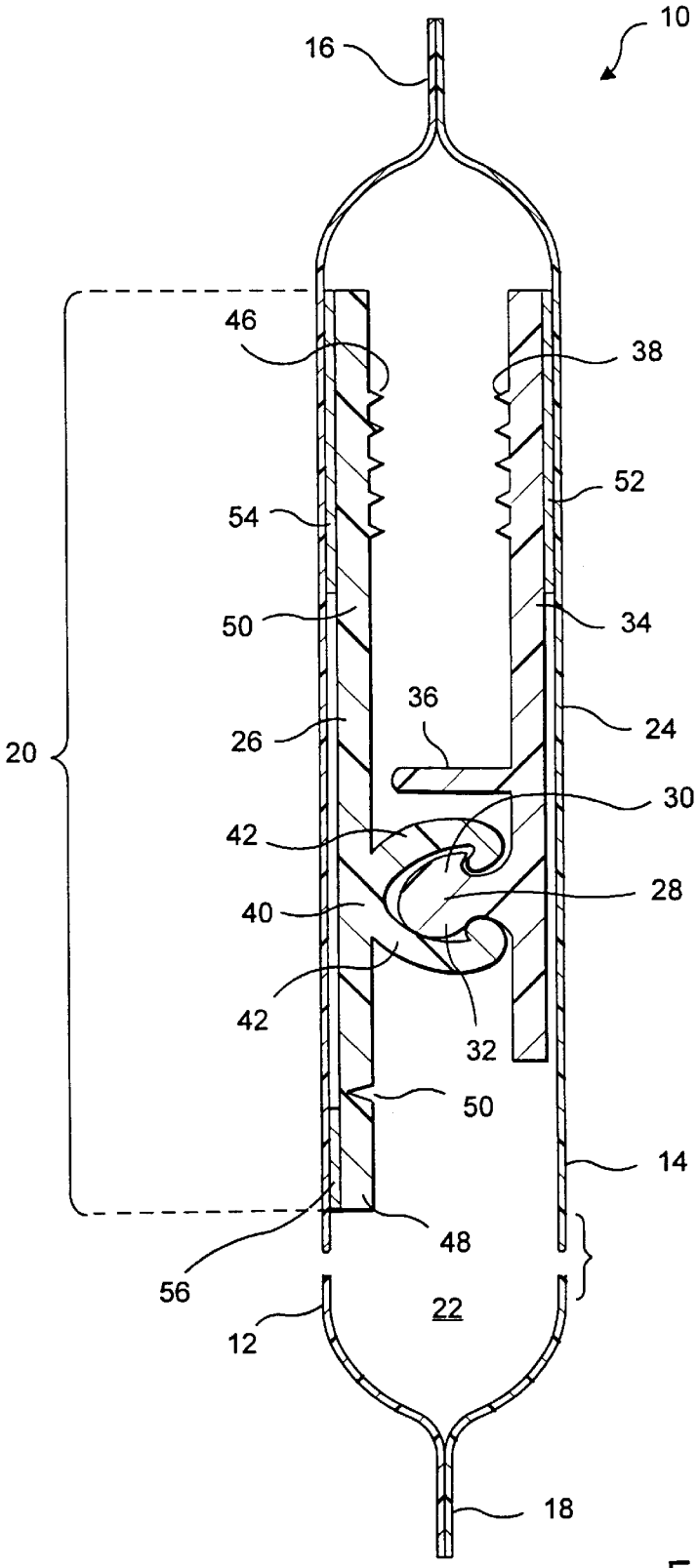
FIG. 1 is a cross-sectional view, taken in a lengthwise or longitudinal direction, of a first embodiment of a reclosable package of the present invention.

Turning now specifically to these figures, FIG. 1 is a cross-sectional view, taken in a lengthwise or longitudinal direction, of a first embodiment of a reclosable package 10 which incorporates the zipper strip 20 of the present invention.

The package 10 includes a front panel 12 and a rear panel 14, both of which may be part of the same single sheet of polymeric film, which, during the simultaneous manufacture of package 10 and its being filled with a consumer product, was wrapped around the filling tube of a vertical FFS machine, and itself place into the form of a tube by having its lateral edges joined together in a fin seal not shown in the figure. Alternatively, the front panel 12 and rear panel 14 may be two separate sheets of polymeric film sealed to one another along their two lateral edges. In any event, the front panel 12 and rear panel 14 are sealed to one another at top seal 16, which forms the top of the package 10, and at bottom seal 18, which forms he bottom of the package 10. For the sake of clarity, the top seal 16 and the bottom seal 18 are shown in the figure exaggeratedly close to one another, and zipper strip 20 is shown exaggeratedly large. In reality, as suggested by the dashed line portions of front panel 12 and rear panel 14 below zipper strip 20, bottom seal 18 is far below top seal 16 and zipper strip 20. The package therefore has a sizeable interior 22 for the consumer product being packaged.

Zipper strip 20 comprises a male interlocking profile 24 and a female interlocking profile 26. The male interlocking profile 24 includes a male interlocking member 28 having an asymmetrical arrowhead-shaped cross section, designed to make the zipper strip 20 easier to open from one side than from the other. Specifically, male interlocking member 28 has an acute edge 30 and a rounded edge 32 on opposite sides thereof. The acute edge 30 faces toward the top seal 16, that is, toward the outside, or consumer side, of the package 10. The rounded edge 32 faces toward the interior 22 of the package 10, that is, inwardly toward the product side of the zipper strip 20. This orientation of the male interlocking member 28 makes the package 10 easier to open from the inside, or product side, than from the outside, or consumer side.

Male interlocking profile 24 also includes a web 34 coextruded with the male interlocking member 28, and may include a guide rib 36 adjacent to the male interlocking member 28. Web 34 may also include gripper ribs 38, outwardly of the male interlocking member 28, to facilitate opening the zipper strip 20.

The female interlocking profile 26 includes a female interlocking member 40 comprising two mutually curving members 42, which form a receptacle or channel into which male interlocking member 28 may be snappingly engaged.

Female interlocking profile 26 includes a web 44 coextruded with the female interlocking member 40. Web 44 of female interlocking profile 26 is wider than web 34 of male interlocking profile 24, and extends farther into the interior 22 of the package 10 than does we b 34. Web 44 may also include gripper ribs 46, outwardly of the female interlocking member 40 and facing gripper ribs 38 on web 34, to facilitate the opening of the zipper strip 20 from the outside. A lower portion 48 of web 44 interior of the female interlocking member 40 is separable from the remainder of web 44 by a line of perforations 50 extending longitudinally therealong.

Male interlocking profile 24 is attached to the rear panel 14 by a heat-seal material layer 52 at one point outwardly of the male interlocking member 28. Female interlocking profile 26, on the other hand, is attach to the front panel 12 by a heat-seal material layer 54 at a point outwardly of the female interlocking member 40, and by a heat-seal material layer 56 at a point inwardly of the female interlocking member 40 and the line of perforations 50.

Both the male interlocking profile 24 and the female interlocking profile 26 may be extruded from a polymeric resin material, such as a low-density polyethylene (LDPE). Heat-seal material layers 52,54,56 may be applied to the male and female interlocking profiles 24,26 by coextrusion or by coating following extrusion. Ethylene vinyl acetate (EVA) copolymers may be used for the heat-seal material layers 52,54,56. Front panel 12 and rear panel 4 are both sheets of polymeric film to which the male and female interlocking profiles 24,26 are sealed, as shown, by heat-seal material layers 52,54, 6.

Package 10 may be opened for the first time in the manner preferred by consumers by pinching the front panel 12 and rear panel 14 at points below zipper strip 20 between the fingers of opposed hands, and by pulling the front panel 12 and rear panel 14 apart from one another.

Initially, the interlocked male and female interlocking members 28,40 are joined to one another strongly enough to permit the separation of the front and rear panels 12,14 to tear the perforations 50. Thereafter, the further separation of the front panel 12 from the rear panel 14 causes the interlocked male and female interlocking profiles 24,26 to rotate in a hingewise fashion upwardly toward top seal 16 to a position where the male and female interlocking members 28,40 easily disengage from one another. Further separation of the front panel 12 from the rear panel 14 beyond this point causes the top seal 16 to separate from within in the manner preferred by consumers.

Lower portion 48 of web 44 of female interlocking profile 26 is also commonly referred to as the leading flange of zipper strip 20. Lower portion 48 is known as the leading flange because, when zipper strip 20 is attached to polymeric film being fed into an FFS machine, the leading flange "leads" the transversely attached zipper strip 20 toward the machine. Ultimately, as seen above, the leading flange, or, in this case, the lower portion 48 of web 44 of female interlocking profile 26, resides inward of the mouths of the plastic bags or packages being manufactured and concurrently filled with a consumer product on an FFS machine. While the female interlocking profile 26 has the leading flange (lower portion 48) in this first embodiment, the leading flange could alternatively be part of the male interlocking profile 24 instead.

The zipper strip 20, as noted above, is disposed transversely across polymeric film during the manufacture of plastic bags or packages on an FFS machine. The zipper strip 20 is dispensed with male and female interlocking profiles 24,26 joined as shown in FIG. 1 onto polymeric film with the female interlocking profile 26 residing thereupon.

Figure 2:
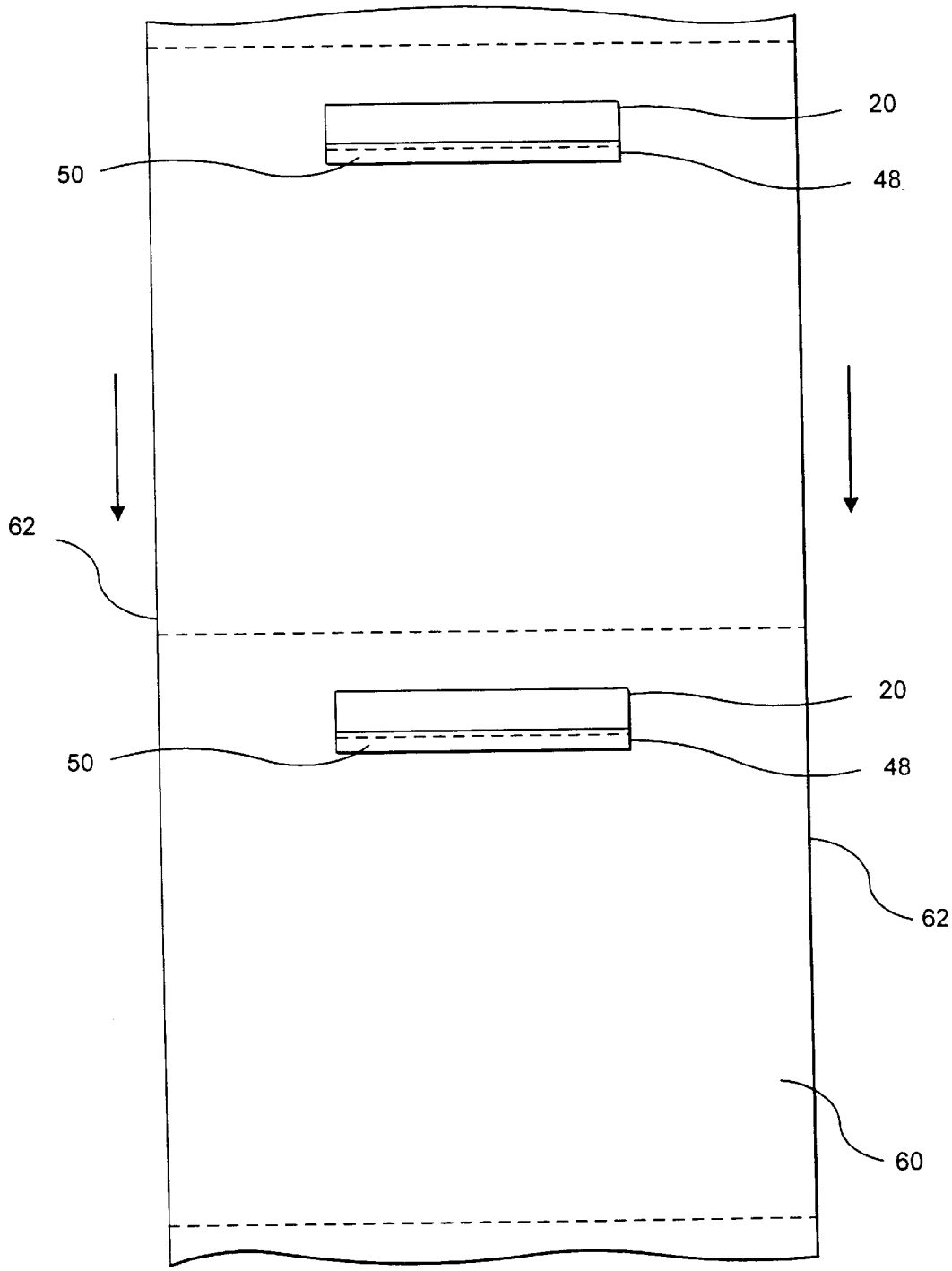
FIG. 2 is a plan view of polymeric film with zipper strips attached transversely thereacross for use in manufacturing the reclosable package shown in FIG. 1.

FIG. 2 is a plan view of the polymeric film, with lengths of zipper strip 20 attached transversely thereacross at regular intervals, used to produce packages on an FFS machine. Polymeric film 60 moves toward the forming collar of a vertical FFS machine in the direction indicated by the arrows. The dashed lines extending transversely across polymeric film 60 indicate the approximate locations of the tops and bottoms of successive packages. Lower portion 48 of web 44 of female interlocking profile 26 "leads" the zipper strip 20 in the running direction of the polymeric film 60, giving meaning to the terminology "leading flange". Perforations 50 are also indicated in FIG. 2. Zipper strip 20 is attached to the center of the polymeric film 60, as shown in FIG. 2, leaving sufficient material along the two lateral edges 62 of the polymeric film 60 to fold over toward one another for joining in an overlap or fin seam. Lower portion 48 is sealed to polymeric film 60 with heat-seal material layer 56. Male interlocking profile 24 is attached to the polymeric film 60 indirectly through its attachment to the female interlocking member 26. Later, when the polymeric film 60 is folded over to form a tube with lateral edges 62 sealed in a fin or overlap seal, the polymeric film 60 is sealed to the male interlocking profile 24 with heat-seal material layer 52 and to the female interlocking profile 26 with heat-seal material layer 54.

Figure 3:
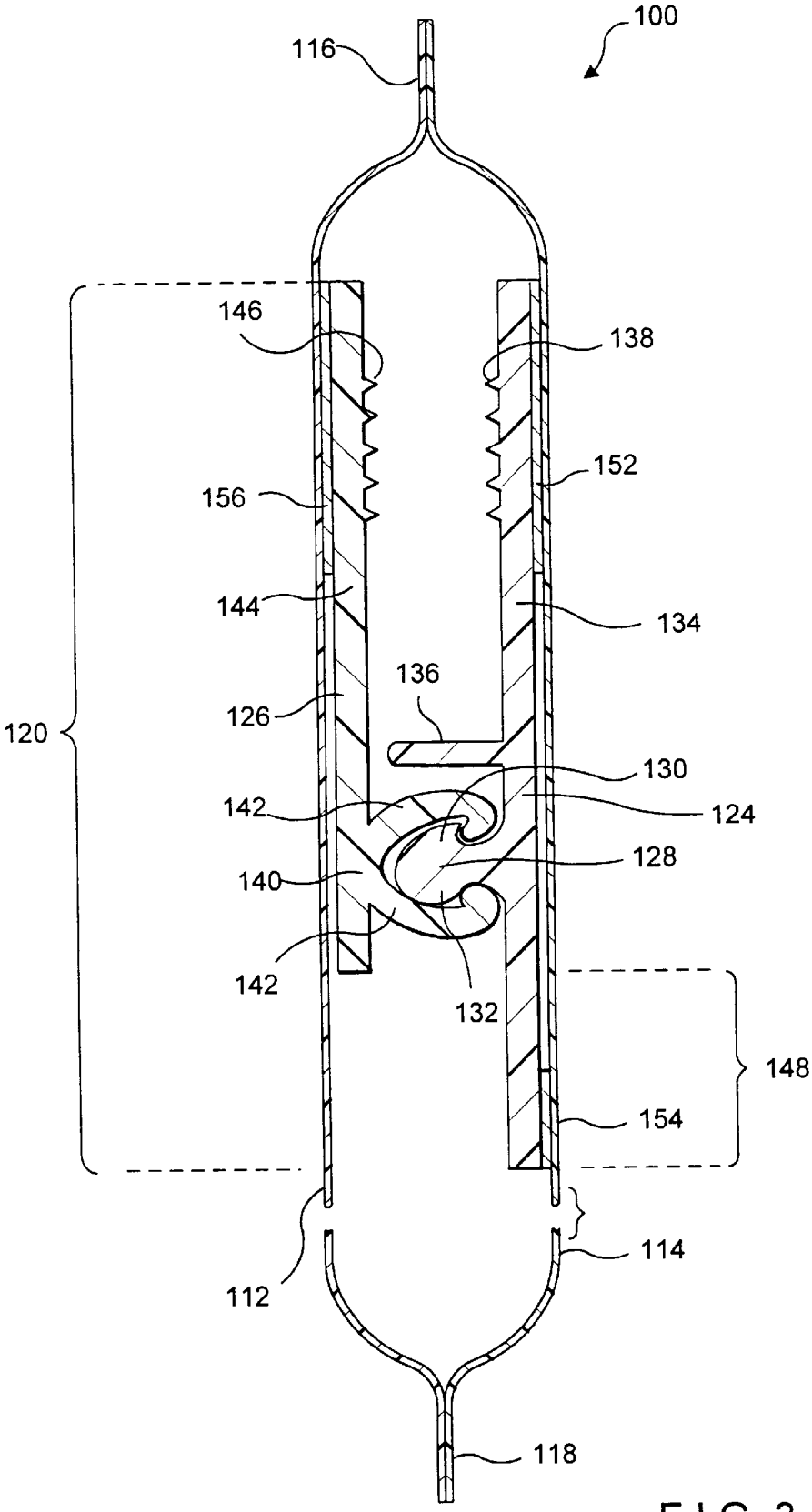
FIG. 3 is a cross-sectional view, like that given in FIG. 1, of an alternate embodiment of the reclosable package of the present invention.

FIG. 3 is a cross-sectional view, taken in a lengthwise or longitudinal direction, of an alternate embodiment of a reclosable package 100 which incorporates the zipper strip 120 of the present invention.

As above, the package 100 includes a front panel 112 and a rear panel 114, both of which may be part of the same single sheet of polymeric film, which, during the simultaneous manufacture of package 100 and its being filled with a consumer product, was wrapped around the filling tube of a vertical FFS machine, and itself placed into the form of a tube by having its lateral edges joined together in a fin seal not shown in the figure. Alternatively, the front panel 112 and rear panel 114 may be two separate sheets of polymeric film sealed to one another along their two lateral edges. In any event, the front panel 112 and rear panel 114 are sealed to one another at top seal 116, which forms the top of the package 100, and at bottom seal 118, which forms the bottom of the package 100. For th sake of clarity, the top seal 116 and the bottom seal 118 are again shown exaggeratedly close to one another, and zipper strip 120 is shown exaggeratedly large. In reality, as suggested by the dashed line portions of front panel 112 and rear panel 114 below zipper strip 120, bottom seal 118 is far below top seal 116 and zipper strip 120.

Zipper strip 120 comprises a male interlocking profile 124 and a female interlocking profile 126. The male interlocking profile 124, as before, includes a male interlocking member 128 having an asymmetrical arrow-shaped cross section, designed to make the zipper strip 120 easier to open from one side than from the other. Specifically, male interlocking member 128 has an acute edge 130 and a rounded edge 132 on opposite sides thereof. The acute edge 130 faces toward the top seal 116, that is, toward the outside, or consumer side, of the package 100. The rounded edge 132 faces toward the interior of the package 100, that is, inwardly toward the product side of the zipper strip 120. This orientation of the male interlocking member 128 makes the package 100 easier to open from the inside, or product side, than from the outside, or consumer side.

Male interlocking profile 124 also includes a web 134 coextruded with the male interlocking member 128, and may include a guide rib 136 adjacent to the male interlocking member 128. Web 134 may also include gripper ribs 138, outwardly of the male interlocking member 138, to facilitate opening the zipper strip 120.

Female interlocking profile 126 includes a female interlocking member 140 comprising two mutually curving members 142, which form a receptacle or channel into which male interlocking member 128 may be snappingly engaged.

Female interlocking profile 126 includes a web 144 coextruded with the female interlocking member 140. Web 144 may also include gripper ribs 146, outward y of the female interlocking member 140 and facing gripper ribs 138 on web 134, to facilitate the opening of the zipper strip 120 from the outside.

Web 134 of male interlocking profile 124 is wider than web 144 of female interlocking profile 126, and extends farther into the interior of the package 100 than does web 144 by an amount indicated in FIG. 3 as lower portion 148.

Male interlocking profile 124 is attached to the rear panel 114 at two points: by a heat-seal material layer 152 at a point outwardly of the male interlocking member 128, and by a heat-seal material layer 154 at a point inwardly of the male interlocking member 128 on lower portion 148. While heat-seal material layer 152 extends for the entire width of the package 100, heat-seal material layer 154 is formed only at the two widthwise ends of the zipper strip 120 in pack age 100, and is preferably lightly tack-sealed or is formed from a peel-seal material. Female interlocking profile 126, on the other hand, is attached to the front panel 112 by a heat-seal material layer 156 at a point outwardly of the female interlocking member 140. As a consequence, for most of the width of the package 100, as will be illustrated below, the female interlocking profile 126 and the male interlocking profile 124 are attached to the front and rear panels 112, 114, respectively, at one point only.

As with the first embodiment discussed above, both the male interlocking profile 124 and the female interlocking profile 126 may be extruded from a polymeric resin material, such as a low-density polyethylene (LDPE). Heat-seal material layers 152, 154,156 may be applied to the male and female interlocking profiles 124,126 by coextrusion or by coating following extrusion. Ethylene vinyl acetate (EVA) copolymers may be used for the heat-seal material layers 152,154,156. Front panel 112 and rear panel 114 are both sheets of polymeric film to which the male and female interlocking profiles 124,126 are sealed, as shown, by heat-seal material layers 152, 154,156.

Package 100 may be opened for the first time in the manner preferred by consumers by pinching the front panel 112 and rear panel 114 at points below zipper strip 120 and in the middle of the package 100 between the fingers of opposed hands, and by pulling the front panel 112 and rear panel 114 apart from one another. The separation of the front panel 112 from the rear panel 114 causes light seal 154 to release and then permits the interlocked male and female interlocking profiles 124,126 to rotate in a hingewise fashion upwardly toward top seal 116 to a position where the male and female interlocking members 128,140 easily disengage from one another. Further separation of the front panel 112 from the rear panel 114 beyond this point causes the top seal 116 to separate from within in the manner preferred by consumers.

As before, lower portion 148 of web 134 of male interlocking profile 124 is the leading flange of zipper strip 120, which is disposed transversely across polymeric film during the manufacture of plastic bags or packages on an FFS machine. In this case, the zipper strip 120 is dispensed with male and female interlocking profiles 124,126 joined as shown in FIG. 3 onto polymeric film with the male interlocking profile 124 resting thereupon.

Figure 4:
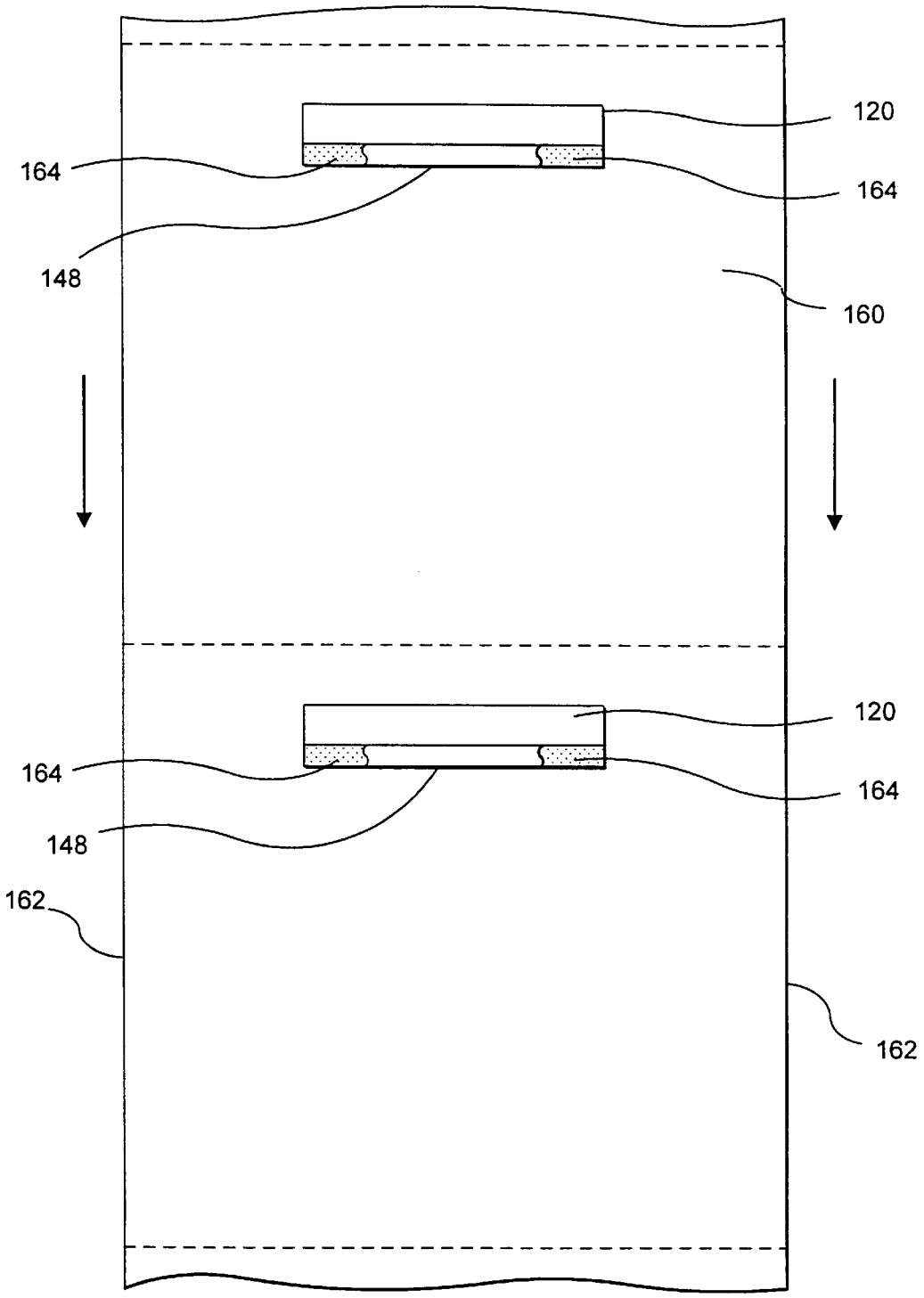
FIG. 4 is a plan view of polymeric film with zipper strips attached thereacross for use in manufacturing the reclosable package shown in FIG. 3.

FIG. 4 is a plan view of the polymeric film, with lengths of zipper strip 120 attached transversely thereacross at regular intervals, used to produce packages on an FFS machine. Polymeric film 160 moves toward he forming collar of a vertical FFS machine in the direction indicated by the arrows. The dashed lines e tending transversely across polymeric film 160 indicate the approximate locations of the tops and bottoms of successive packages. Lower portion 148 of web 134 of male interlocking profile 124 "leads" the zipper strip 120 in the running direction of the polymeric film 160. Zipper strip 120 is attached to the center of the polymeric film 160, as shown in FIG. 4, leaving sufficient material along the two lateral edges 162 of the polymeric film 160 to fold over toward one another for joining in an overlap or fin seam. Lower portion 148 is sealed to polymeric film 160 with heat-seal material layer 154 at the two widthwise ends 164 of the lower portion 148. Female interlocking profile 126 is attached to the polymeric film 160 indirectly through its attachment to the male interlocking member 124. Later, when the polymeric film 160 is folded over to form a tube with lateral edges 62 sealed in a fin or overlap seal, the polymeric film 160 is sealed to the male interlocking profile 124 with heat-seal material layer 152 and to the female interlocking profile 126 with heat-seal material layer 156.

Modifications to the above would be obvious to those of ordinary skill in the art, but would not bring the invention so modified beyond the scope of the appended claims.

What is claimed is:

1. A reclosable package for a consumer product, said reclosable package comprising:

a front panel and a rear panel, said front and rear panels being joined to one another to form a package tube sealed transversely at a top and a bottom by a top seal and a bottom seal, respectively;

a male interlocking profile attached to one of said front and rear panels transversely thereacross within sad package tube adjacent to said top seal, said male interlocking profile having a male interlocking member; and a female interlocking profile attached to the other of said front and rear panels transversely thereacross within said package tube adjacent to said top seal, said female interlocking profile having a female interlocking member, said female interlocking member having a channel wherein said male interlocking member is snappingly engaged to join said male and female interlocking profiles together, said male interlocking member being configured so as to enable said male interlocking profile to be separated from said female interlocking profile with a smaller opening force when being separated in a direction toward said top seal than in a direction toward said bottom seal.

2. A reclosable package as claimed in claim 1 further comprising a female web extruded integrally with said female interlocking profile, said female web extending primarily in one direction from said female interlocking member toward said top seal, said female interlocking profile being attached to the other of said front and rear panels at an end of said female web closest to said top seal, said female interlocking member having two mutually curving members forming a channel therebetween wherein said male interlocking member is snappingly engaged to join said male and female interlocking profiles together.

3. A reclosable package as claimed in claim 2 wherein one of said male and female webs has a portion extending toward said bottom seal.

4. A reclosable package as claimed in claim 3 wherein said portion of one of said male and female webs i separated from a remainder thereof by a line of perforations.

5. A reclosable package as claimed in claim 3 wherein said portion of one of said male and female webs i attached to one of said front and rear panels only at the transverse ends thereof.

6. A reclosable package as claimed in claim 2 wherein said male interlocking profile further comprises a plurality of gripper ribs on said end of said male web closest to said top seal.

7. A reclosable package as claimed in claim 2 wherein said female interlocking profile further comprises a plurality of gripper ribs on said end of said female web closest to said top seal.

8. A reclosable package as claimed in claim 2 wherein said male interlocking profile further comprises a guide rib on said male web, said guide rib being adjacent to said male interlocking member and oriented toward said female web.

9. A reclosable package as claimed in claim 2 wherein said male and female interlocking profiles are extruded from a polymeric resin material.

10. A reclosable package as claimed in claim 9 wherein said polymeric resin material is a low-density polyethylene (LPDE).

11. A reclosable package as claimed in claim 2 wherein said male and female interlocking profiles are attached to said front and rear panels with a heatseal material.

12. A reclosable package as claimed in claim 11 wherein said heat-seal material is an ethylene vinyl acetate (EVA) copolymer.

* * * * *